US010961727B2

(12) United States Patent
Rosales

(10) Patent No.: US 10,961,727 B2
(45) Date of Patent: Mar. 30, 2021

(54) CONCRETE FORM ASSEMBLY HAVING CONCRETE FORM CLIP AND METHOD OF FORMING A WALL

(71) Applicant: JD RUSSELL COMPANY, Utica, MI (US)

(72) Inventor: Louis Rosales, Pasco, WA (US)

(73) Assignee: JD RUSSELL COMPANY, Utica, MI (US)

( * ) Notice: Subject to any disclaimer, the term of this patent is extended or adjusted under 35 U.S.C. 154(b) by 0 days.

(21) Appl. No.: 16/406,261

(22) Filed: May 8, 2019

(65) Prior Publication Data

US 2020/0354979 A1 Nov. 12, 2020

(51) Int. Cl.

| | |
|---|---|
| ***E04G 17/12*** | (2006.01) |
| ***E04G 17/14*** | (2006.01) |
| ***E04G 17/06*** | (2006.01) |

(52) U.S. Cl.

CPC ..... *E04G 17/12* (2013.01); *E04G 17/06* (2013.01); *E04G 17/14* (2013.01); *E04G 2017/0646* (2013.01)

(58) Field of Classification Search

CPC ..... E04G 2017/0646; E04G 17/12
USPC .... 249/2, 3, 4, 5, 6, 7, 8, 34, 213, 214, 216, 249/218

See application file for complete search history.

(56) References Cited

U.S. PATENT DOCUMENTS 1,126,190 A * 1/1915 Fuehrer ..... E04G 17/0721 249/214
1,644,584 A * 10/1927 Heltzel ..... E01C 19/506 249/5
1,708,634 A * 4/1929 Rees ..... E04G 17/0721 249/218
1,712,631 A * 5/1929 Nelson ..... E04G 17/0754 249/33
1,850,462 A * 3/1932 Kinninger ..... E04G 17/0754 52/98
1,863,177 A * 6/1932 Wilson ..... E04G 17/0754 249/190
1,978,963 A * 10/1934 Schwaab ..... E04G 17/0721 249/218
2,442,962 A * 6/1948 Rumble ..... E04G 11/18 249/38
2,911,702 A * 11/1959 Clyncke ..... E04G 13/00 249/207
3,350,123 A * 10/1967 Loving ..... E06B 1/6015 403/188
3,722,849 A * 3/1973 Luyben ..... E04G 13/00 249/219.1

(Continued)

FOREIGN PATENT DOCUMENTS

JP 04016673 A * 1/1992 ..... E04G 17/0646

*Primary Examiner* — Michael Safavi
(74) *Attorney, Agent, or Firm* — Carlson, Gaskey & Olds

(57) ABSTRACT

An illustrative example embodiment of a concrete form clip includes a body including two ends and a plurality of arms. One of the arms is near each of the ends. The arms are oriented transverse to the body. A plurality of projections extend from the body. Each of the projections is spaced from a respective one of the arms with a spacing between the projection and the respective arm to accommodate a portion of an edge of a form panel. At least one tab on at least one of the arms is transverse to the arm. The tab includes a tool receiving surface that facilitates using a tool to manipulate the clip relative to a form panel, which simplifies the task of removing the clip from the form panel.

19 Claims, 2 Drawing Sheets

(56) References Cited

U.S. PATENT DOCUMENTS 4,246,736 A * 1/1981 Kovar ..... E04C 3/02 52/696
4,257,571 A * 3/1981 Franks ..... E04G 13/00 249/177
4,637,195 A * 1/1987 Davis ..... E04C 3/38 52/657
D318,785 S * 8/1991 Dean ..... 52/696
5,042,218 A * 8/1991 Nasca ..... E04C 5/168 52/677
5,207,931 A * 5/1993 Porter ..... E04G 13/00 249/210
5,606,837 A * 3/1997 Holizlander ..... E04C 3/02 52/639
5,628,119 A * 5/1997 Bingham ..... E04G 21/1891 33/613
5,670,076 A * 9/1997 Leek ..... E04G 21/185 249/219.1
6,173,937 B1 * 1/2001 Cottongim ..... E04G 17/045 249/190
6,698,348 B1 * 3/2004 Bloss ..... B41N 1/24 101/127
7,213,377 B1 * 5/2007 Sackett ..... E04C 3/02 52/696
7,229,062 B1 * 6/2007 Rascon ..... E04G 13/00 249/218
8,646,746 B2 * 2/2014 Boese ..... E04B 1/16 249/216
D819,232 S * 5/2018 Santjer ..... E04G 17/064 D25/133
D856,784 S * 8/2019 Zeilinger ..... D8/354
2006/0071142 A1 * 4/2006 Jessop ..... E04G 13/00 249/219.1
2015/0102204 A1 * 4/2015 Santjer ..... E04G 17/064 249/219.1
2015/0345133 A1 * 12/2015 Sidhu ..... E04B 5/12 52/167.1

* cited by examiner

CONCRETE FORM ASSEMBLY HAVING CONCRETE FORM CLIP AND METHOD OF FORMING A WALL

BACKGROUND

Concrete is used for a variety of construction purposes. In many instances concrete structures, such as walls, are made by erecting forms and filling the space between the forms with concrete. After the concrete cures, the forms are removed, leaving the concrete in place.

Forms for making concrete structures typically have to be supported in place and secured relative to each other to ensure that the concrete will have the desired shape, size and position. A variety of ties and braces have been developed to assist in assembling and supporting the forms on a job site. One drawback to some available ties is that the process of removing them from the forms after the concrete has cured is labor intensive and time consuming. Some existing ties act as a clip received over the edges of the forms. Such clips becomes tightly wedged in place as a result of the concrete pressure between the form panels and removing them is difficult. In some situations a worker tends to damage the form while attempting to separate the clips from the forms.

SUMMARY

An illustrative example embodiment of a concrete form clip includes a body including two ends and a plurality of arms. One of the arms is near each of the ends. The arms are oriented transverse to the body. A plurality of projections extend from the body. Each of the projections is spaced from a respective one of the arms with a spacing between the projection and the respective arm to accommodate a portion of an edge of a form panel. At least one tab on at least one of the arms is transverse to the arm. The tab includes a tool receiving surface that facilitates using a tool to manipulate the clip relative to a form panel, which simplifies the task of removing the clip from the form panel.

An illustrative example method of removing a concrete form clip that is received over an edge of a form panel includes engaging a surface on a tab that extends transversely from an arm of the clip received against the panel with a tool. The method includes using the tool to manipulate the tab relative to the panel to move at least the arm away from the panel.

Various features and advantages of at least one disclosed embodiment will become apparent to those skilled in the art from the following detailed description. The drawings that accompany the detailed description can be briefly described as follows.

DETAILED DESCRIPTION

Figure 1:
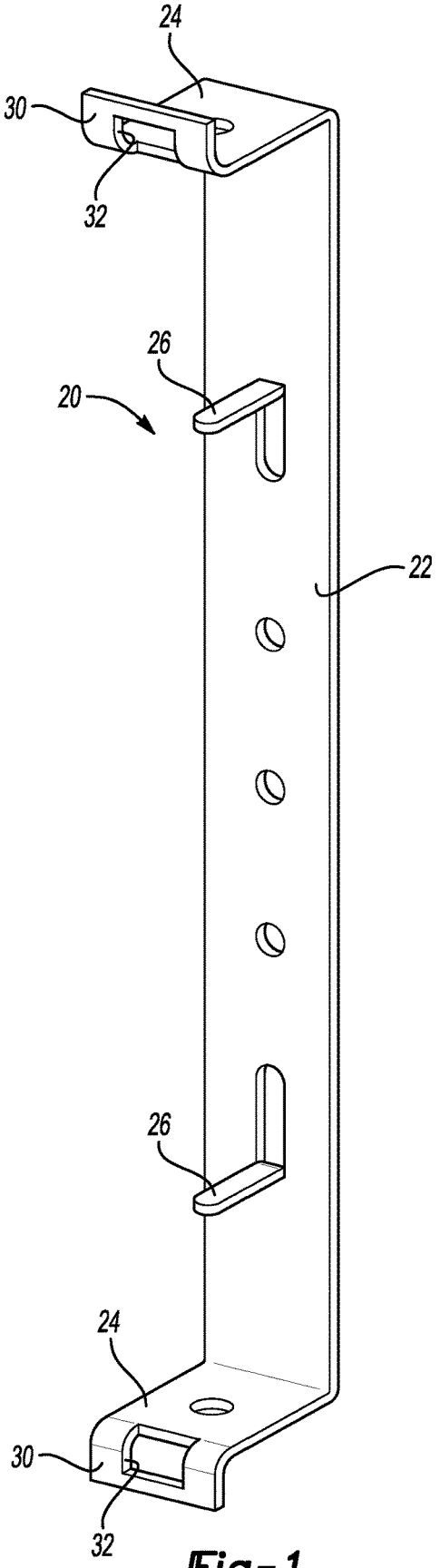
FIG. 1 diagrammatically illustrates an example concrete form clip designed according to an embodiment of this invention.

FIG. 1 shows a concrete form clip 20 that is useful for holding form panels. The example clip 20 includes a body 22 and arms 24 near each of two ends of the body 22. The arms 24 are transverse to the body 22. Projections 26 extend from the body 22 and are each spaced from a respective one of the arms 24 a distance that accommodates a portion of a form panel between one of the projections 26 and arms 24. The projections 26 and arms 24 in this example are perpendicular to the body 22.

At least one tab 30 extends from at least one of the arms 24. In the illustrated example, each of the arms 24 includes a tab 30. Each tab 30 is transverse to the respective arm 24. In this example, the tabs 30 are perpendicular to the arms 24 and parallel with the body 22.

The tabs 30 each include a tool receiving surface that facilitates a worker using a tool to manipulate the clip 20 when it is time to remove the clip 20 from a form. In the example of FIG. 1, the tool receiving surface includes a recess 32 in the tab. The recess 32 in this embodiment is an opening through the tab 30.

Figure 2:
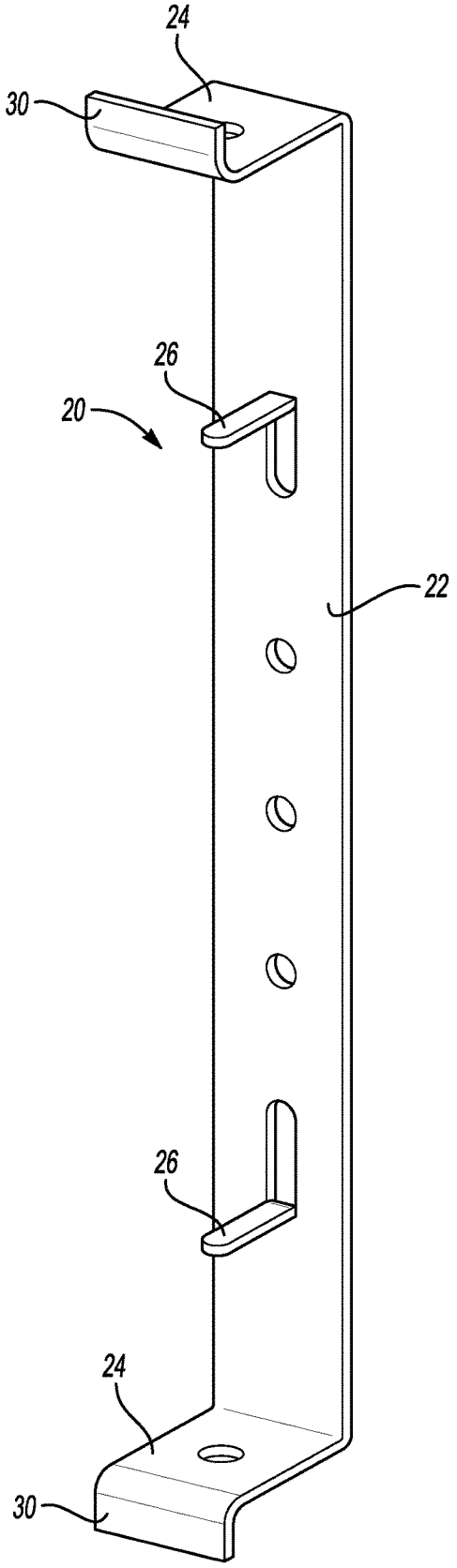
FIG. 2 diagrammatically illustrates another example concrete form clip designed according to an embodiment of this invention.

FIG. 2 shows another example embodiment that includes tabs 30 with a flat tool receiving surface 34 that does not have a recess or opening. The example clips shown in FIGS. 1 and 2 are formed as a single-piece, unitary structure. In some embodiments, the body 22, arms 24, projections 26 and tabs 30 are all formed from a single piece of metal. In some embodiments the entire clip 20 is a stamping of a single piece of metal. Other embodiments include a molded or cast structure.

The position and size of the tabs 30 may vary from those shown in the illustrated examples. The tabs 30 provide at least one reaction surface that facilitates an individual using a tool to manipulate the clip 20 relative to a form. The tabs 30 are useful, for example, during a process of removing the clip 20 from a form panel.

Figure 3:
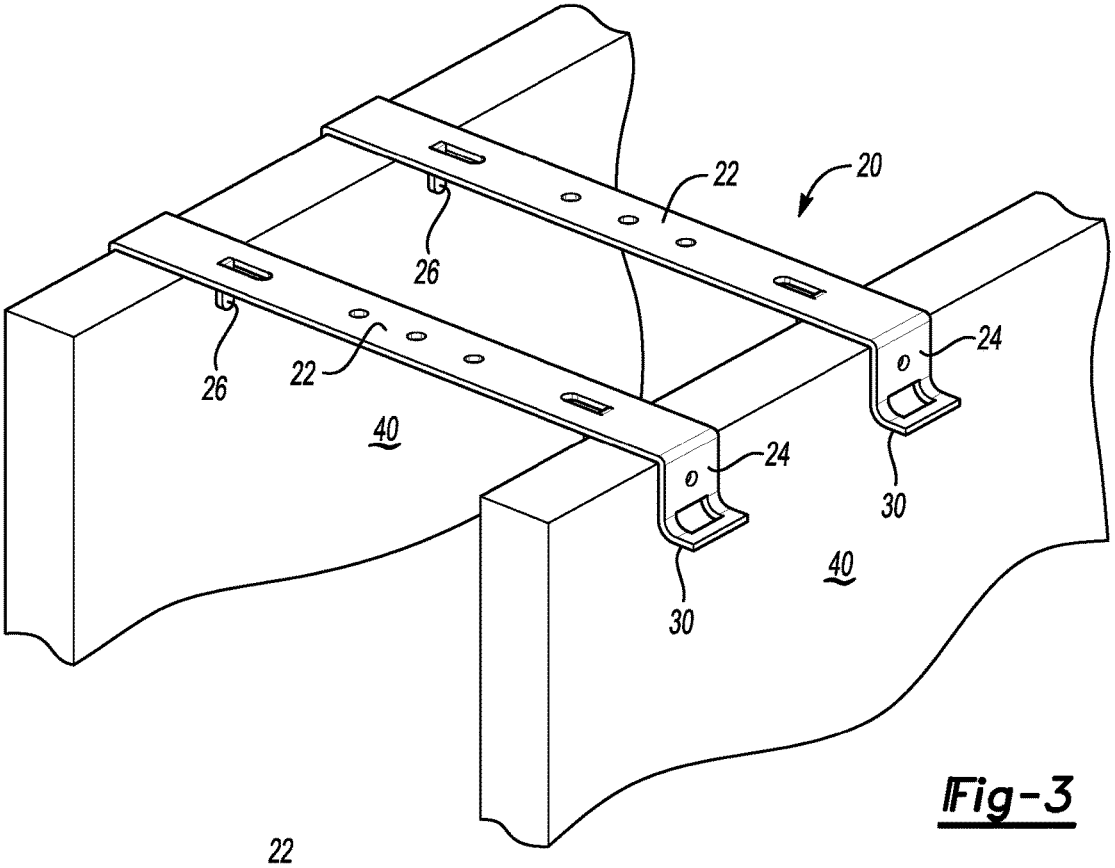
FIG. 3 diagrammatically shows example concrete form clips in use with form panels.

FIG. 3 illustrates a plurality of clips 20 received over edges of form panels 40. As can be appreciated from the drawing, the body 22 has a length that corresponds to a distance from the outside edge of one of the form panels 40 to the outside edge of the other form panel 40. The arms 24 are received against the outside surfaces of the form panels 40. The tabs 30 extend transversely from the arms 24 and in this example are perpendicular to the form panels 40.

The projections 26 are received against the inside edges of the form panels 40 and spaced apart by a distance corresponding to the thickness of a concrete structure, such as a wall, established between the form panels 40. In other words, the distance between the form panels 40 is set, at least in part, by the distance between the projections 26.

Figure 4:
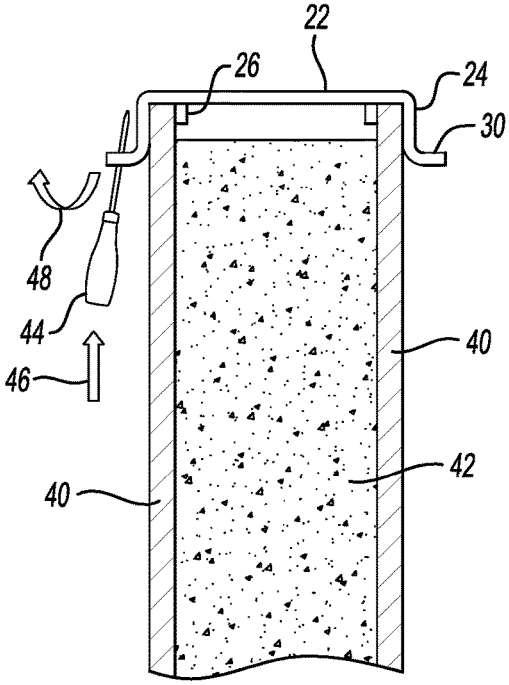
FIG. 4 schematically illustrates an example technique of removing an example clip from form panels.

FIG. 4 schematically illustrates a technique for removing the clips 20 from the form panels 40. In FIG. 4, concrete within the form has cured forming a structure 42, such as a wall. A worker can use a tool 44, such as a screwdriver, and move the tool 44 as shown by the arrow 46 to insert a portion of the tool 44 through the opening 32 in one of the tabs 30. Then the worker can move the tool as shown by the arrow 48 to manipulate the arm 24 and the clip 20 relative to the form panel 40. Such motion facilitates freeing the clip 20 from the form panel 40.

In some embodiments, moving the tool 44 as shown at 48 will cause some flexing of the body 22, the arm 24, or both to release the clip 20 from the form panel 40. The pressure within the form caused by the concrete of the structure 42 makes it difficult to remove the clip 20 and the tab 30 with the tool receiving recess 32 simplifies that task. The tab 30 provides leverage to a worker that facilitates manipulating the clip 20 relative to the form panel 40 so the clip can be more easily removed. The tab 30 also reduces a likelihood that the worker will damage the form panel 40 in the area of the clip 20 because the tool 44 can be used without making any contact with the form panel 40.

Although the tool 44 is shown moving in an upward direction in FIG. 4, it is also possible to insert the tool 44 into the recess 32 from above the clip 20 and then manipulate the arm 24 and clip 20 to separate the clip 20 from the form panel 40.

Figure 5:
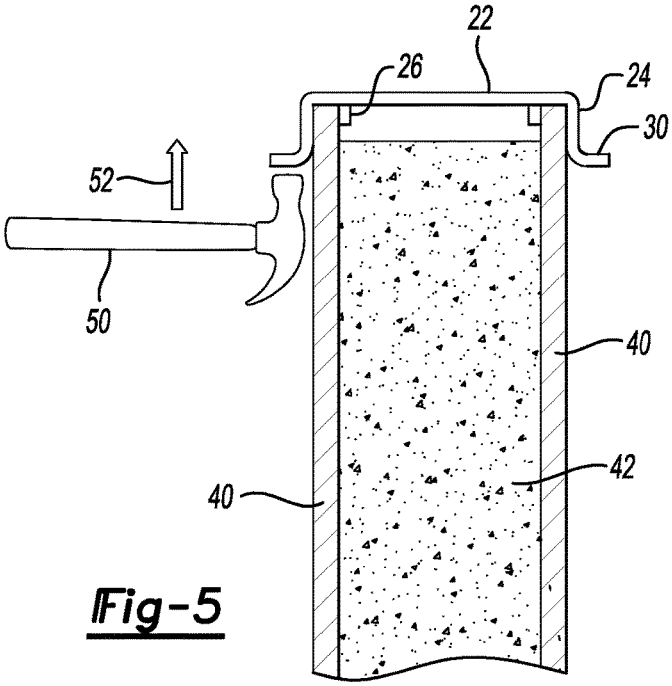
FIG. 5 schematically illustrates another example technique of removing an example clip from form panels.

FIG. 5 illustrates a technique for removing the clip 20 shown in FIG. 2 from a form panel 40 after a concrete structure 42 has been formed. In this example, a hammer 50 or a similar tool is used to strike the tool receiving surface 34 on the tab 30 as shown by the arrow 52. The tab 30 and tool receiving surface 34 makes it possible for a worker to use a tool to simplify the task of removing the clip 20 without damaging or even contacting the form panel 40.

The technique shown in FIG. 5 can also be used with a clip 20 that includes an opening or other recess on the tab 30 like the embodiment shown in FIGS. 1 and 3.

A concrete form clip that includes features of the disclosed embodiments is easier to remove once a concrete structure has been formed. The example clips reduce the time and complexity of removing clips. Since many job sites include many clips the disclosed example clips and removal techniques provide substantial labor expense savings. Additionally, with the example clips it is less likely that a form panel will be damaged when a worker attempts to remove the clips.

The preceding description is exemplary rather than limiting in nature. Variations and modifications to the disclosed examples may become apparent to those skilled in the art that do not necessarily depart from the essence of this invention. The scope of legal protection given to this invention can only be determined by studying the following claims.

I claim:

1. An assembly, comprising:
at least two form panels;
concrete situated between the two form panels; and
a concrete form clip, comprising
a body including two ends;
a plurality of arms, one of the arms being near one of the ends, another one of the arms being near another one of the ends, the arms being oriented transverse to the body;
a plurality of projections extending from the body, each of the projections being spaced from a respective one of the arms with a spacing between the projection and the respective arm accommodating a portion of an edge of one of the form panels; and
at least one tab on at least one of the arms, the at least one tab being transverse to the at least one of the arms, the at least one tab including a tool receiving surface that facilitates using a tool to manipulate the clip relative to at least one of the form panels for removing the concrete form clip from the at least one of the form panels, wherein the tool receiving surface comprises a recess in the tab that is configured to receive a portion of a tool.

2. The assembly of claim 1, wherein the at least one tab comprises a plurality of tabs and each of the arms includes one of the tabs.

3. The assembly of claim 1, wherein the recess comprises an opening through the tab.

4. The assembly of claim 1, wherein the entire clip is a unitary, single-piece structure including the body, the arms, the projections and the at least one tab.

5. The assembly of claim 4, wherein the entire clip is formed from a single piece of metal.

6. The assembly of claim 5, wherein the single piece of metal is stamped to form the arms, the projections and the at least one tab.

7. The assembly of claim 1, wherein
the body is flat;
the arms are flat and perpendicular to the body; and
the at least one tab is flat and perpendicular to the at least one of the arms.

8. A method of using a concrete form clip, the method comprising:
placing the concrete form clip over edges of form panels to establish a desired spacing between the form panels at least in a vicinity of the edges prior to concrete being poured into the spacing between the form panels, wherein arms of the concrete form clip are respectively received against outside surfaces of the form panels and projections of the concrete form clip are respectively received against inside surfaces of the form panels; and
subsequent to a curing of concrete in the spacing,
engaging a surface on a tab with a tool, wherein the tab is on one of the arms and extends away from the one of the arms in a direction away from the outside surface of the corresponding form panel, wherein the tab includes a recess and engaging the surface on the tab with the tool includes inserting a portion of the tool into the recess; and
using the tool to manipulate the tab relative to at least the corresponding form panel to move at least the arm away from the corresponding form panel.

9. The method of claim 8, comprising using the tool to manipulate the tab relative to the corresponding form panel to move the entire clip away from the corresponding form panel.

10. The method of claim 8, wherein using the tool includes pivoting the clip relative to the corresponding form panel.

11. The method of claim 8, wherein the recess comprises an opening through the tab and engaging the surface on the tab with the tool includes inserting a portion of the tool through the recess.

12. The method of claim 11, wherein using the tool to manipulate the tab relative to the corresponding form panel includes pivoting the tool and the arm relative to the corresponding form panel after inserting the portion of the tool through the recess.

13. An assembly, comprising:
at least two form panels;
concrete situated between the two form panels; and
a concrete form clip, comprising
a body including two ends;
a plurality of arms, one of the arms being near one of the ends, another one of the arms being near another one of the ends, the arms being oriented transverse to the body;
a plurality of projections extending from the body, each of the projections being spaced from a respective one of the arms with a spacing between the projection and the respective arm accommodating a portion of an edge of one of the form panels; and
at least one tab on at least one of the arms, the at least one tab being transverse to the at least one of the arms, the at least one tab including a tool receiving surface that facilitates using a tool to manipulate the clip relative to at least one of the form panels for removing the concrete form clip from the at least one of the form panels, wherein the body is flat, the arms are flat and perpendicular to the body, and the at least one tab is flat and perpendicular to the at least one of the arms.

14. The assembly of claim 13, wherein the tool receiving surface comprises a recess in the tab that is configured to receive a portion of a tool.

15. The assembly of claim 13, wherein the at least one tab comprises a plurality of tabs and each of the arms includes one of the tabs.

16. The assembly of claim 14, wherein the recess comprises an opening through the tab.

17. The assembly of claim 13, wherein the entire clip is a unitary, single-piece structure including the body, the arms, the projections and the at least one tab.

18. The assembly of claim 17, wherein the entire clip is formed from a single piece of metal.

19. The assembly of claim 18, wherein the single piece of metal is stamped to form the arms, the projections and the at least one tab.

* * * * *